United States Patent [19]

Chermin

[11] 4,181,872

[45] Jan. 1, 1980

[54] STARTER FOR IGNITING A GAS AND/OR VAPOR DISCHARGE LAMP

[75] Inventor: Hubertus M. J. Chermin, Eindhoven, Netherlands

[73] Assignee: U.S. Philips Corporation, New York, N.Y.

[21] Appl. No.: 854,114

[22] Filed: Nov. 23, 1977

[30] Foreign Application Priority Data

Dec. 1, 1976 [NL] Netherlands ..... 7613356

[51] Int. Cl.[2] ..... H05B 39/04; H05B 41/36

[52] U.S. Cl. ..... 315/106; 315/209 CD; 315/224; 315/240; 315/245; 315/DIG. 5

[58] Field of Search ..... 315/94, 105, 106, 107, 315/209 R, 209 CD, 224, 227 R, 240, 245, 362, DIG. 2, DIG. 5, 101

[56] References Cited

U.S. PATENT DOCUMENTS

| | | | |
|---|---|---|---|
| 3,659,150 | 4/1972 | Laupman | 315/106 |
| 4,082,981 | 4/1978 | Morton et al. | 315/DIG. 5 |

*Primary Examiner*—Eugene R. LaRoche
*Assistant Examiner*—Robert E. Wise
*Attorney, Agent, or Firm*—Thomas A. Briody; William J. Streeter; Bernard Franzblau

[57] ABSTRACT

The invention relates to a starter for igniting a low-pressure sodium lamp. The starter is provided with an oscillator circuit consisting of an electric coil, a first capacitor and a controlled semiconductor switching element.

In accordance with the invention the starter also comprises a parallel circuit of a resistor having a positive temperature coefficient and a second capacitor, this parallel circuit and the oscillator circuit being in series. This series circuit is connected between two electrodes of the lamp. In the case where a defective lamp must be replaced by a new lamp—the supply voltage being switched on—in spite of the hot state of the resistor with positive temperature coefficient a plurality of starting pulses will nevertheless be passed through the second capacitor to the new lamp whereafter this lamp can ignite.

10 Claims, 3 Drawing Figures

STARTER FOR IGNITING A GAS AND/OR VAPOR DISCHARGE LAMP

Figure 1:
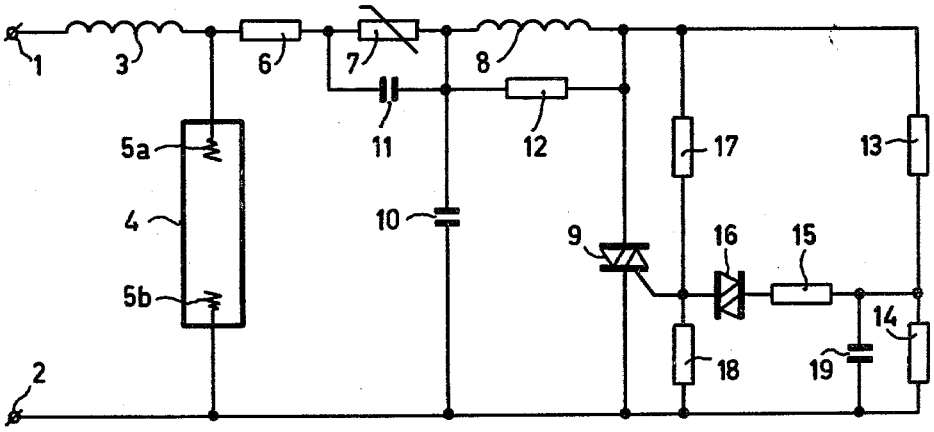

The invention relates to a starter for igniting a gas and/or vapour discharge lamp. The starter is provided with two input terminals intended for connection to a first and a second electrode respectively of the lamp, the input terminals being interconnected by a series arrangement of at least an electric coil and a controlled semiconductor switching element, and wherein a portion of the series arrangement which comprises the coil and the semiconductor switching element is shunted by a first capacitor. The invention also relates to an arrangement provided with such a starter, which arrangement furthermore comprises a gas and/or vapour discharge lamp to be started by means of this starter.

A known starter of the type mentioned in the preamble is, for example, described in U.S. Pat. application Ser. No. 744,147, filed July 11, 1968, and now abandoned. A disadvantage of that known starter is that it also remains in operation if the lamp refuses to ignite. This means that current then flows unnecessarily through the stabilisation ballast of the lamp. This results in losses, which is a disadvantage.

It is true that it has already been proposed to provide a lamp starter with a temperature-sensitive resistor which resistor is raised, in the case where the lamp refuses to ignite, to a higher temperature which causes its ohmic value to change. The result is that the starter is substantially put out of operation. See for example, German "Offenlegungsschrift" No. 2,032,446.

A disadvantage of this known protection is, however, that if, with the power supply switched on, an old lamp which does not start is replaced in a rapid manner by a new, good lamp the temperature-sensitive resistor—when the new lamp is fitted—is still in its high temperature range so that the new lamp cannot start. This disadvantageous situation may also occur—and that more frequently—if a discharge lamp is replaced which is provided with electrodes of a non-preheatable type. In that case the removal of a lamp does not as a rule switch off the AC voltage supply of the starter.

It is an object of the invention to provide a starter of the type mentioned in the preamble which is substantially put out of operation if the lamp refuses to ignite but wherein, when a failing lamp is replaced by a new lamp, starting voltage pulses are nevertheless delivered to this new lamp.

A starter according to the invention for igniting a gas and/or vapour discharge lamp, which starter is provided with two input terminals intended for connection to a first and a second electrode, respectively of the lamp, wherein the input terminals are connected by a series arrangement of at least an electric coil and a controlled semiconductor switching element and wherein a portion of the series arrangement which comprises the coil and the semiconductor switching element is shunted by a first capacitor, is characterized in that a parallel connection of a resistor having a positive temperature coefficient and a second capacitor is disposed in the remaining portion of the series arrangement.

An advantage of the use of a starter according to the invention is that, if—with the supply power switched on—a defective lamp is replaced by a new lamp, starting pulses may nevertheless be available for igniting that new lamp. These starting pulses are generated in the circuit of the starter which comprises the electric coil and the first capacitor. The possibility that these pulses—in the hot condition of the resistor with positive temperature coefficient (P.T.C. resistor)—appear between the lamp electrodes is now, in accordance with the invention, realized by the second capacitor. It should be noted that the hot—and hence high-ohmic—P.T.C. resistor could not pass these pulses. The starting pulses are, it is true, not so strong, or in other words have less energy than in the case of a cold P.T.C. resistor. This is caused, inter alia, because the P.T.C. resistor in the cold state impedes the passage of energy to the oscillator circuit of the coil and the first capacitor to a lesser degree than in the hot state.

In a preferred embodiment of a starter according to the invention the capacitance of the second capacitor is between 80 nanofarad and 300 nanofard. An advantage of this preferred embodiment is that the parallel arrangement of the P.T.C. resistor in the hot state and the second capacitor has a high impedance for the usual AC supply frequencies of 50 to 60 Hz, but a lower impedance to the high frequency pulses which are generated in the oscillator circuit consisting of the electric coil and the first capacitor.

The invention also relates to an arrangement provided with said starter wherein this arrangement comprises a gas and/or vapour discharge lamp which is provided with two electrodes, wherein one input terminal of the starter is connected to one electrode—and the second input terminal to the other electrode—of the lamp, the arrangement furthermore comprising a stabilisation element (a ballast) which is provided with an inductive part and which is connected in series with the lamp.

In an improvement of said last preferred embodiment, the lamp is a low-pressure sodium vapour discharge lamp. An advantage of this improvement is that this lamp, which is generally used for public illumination purposes, can now be started directly even if the P.T.C. resistor of its starter is in the hot, that is to say in the high ohmic state.

Figure 2A:
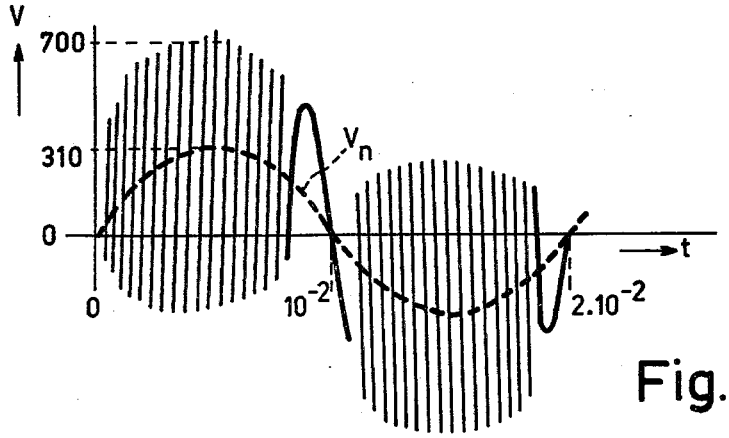
Figure 2B:
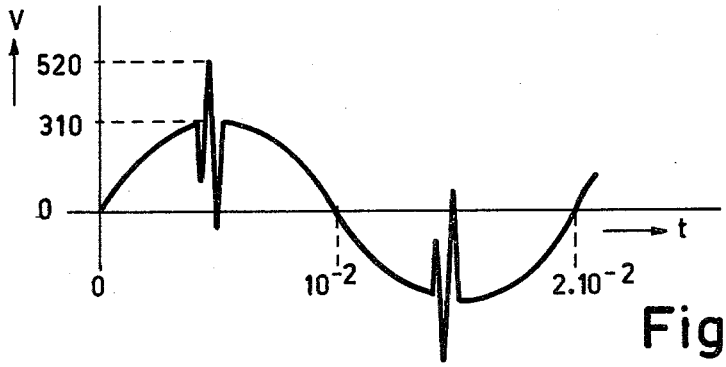

The invention will be further explained with reference to the accompanying drawing, wherein:

FIG. 1 shows an electric circuit of the arrangement according to the invention;

FIG. 2*a* shows the voltage between the electrodes of a lamp of the arrangement of FIG. 1 as a function of the time, in a cold state of a P.T.C. resistor of that arrangement, and FIG. 2*b* shows the voltage between the electrodes of the arrangement of FIG. 1 as a function of the time, in a hot state of that P.T.C. resistor.

In FIG. 1 connecting terminals which are intended for connection to an a.c. voltage source of approximately 220 Volts, 50 Hz. Terminal 1 is connected to an inductive stabilisation ballast 3. The other side of this ballast 3 is connected to an electrode **5*a* of a low-pressure sodium vapour discharge lamp 4 of approximately 35 Watts. The lamp is shown diagrammatically only. A second electrode 5*b* of the lamp 4 is connected to the input terminal 2. The two electrodes 5*a* and 5*b* are of a non-preheatable type. In addition the electrode 5*a* is connected to a series arrangement consisting of a resistor 6, a P.T.C. resistor 7, an electric coil 8, and a semiconductor switching element 9 having a bidirectional thyristor characteristic (triac). The other side of the semiconductor switching element 9 is connected to the electrode 5*b* of the lamp 4. A first capacitor 10 shunts the series arrangement of the coil 8 and the semiconductor switching element 9. A second capacitor 11 is in parallel with the P.T.C. resistor 7. In addition, the coil 8 is shunted by a damping resistor 12. Furthermore a control circuit for the semiconductor switching element 9 comprises a series arrangement of two resistors 13 and 14, which series arrangement is in parallel with the semiconductor switching element 9. A junction between the resistors 13 and 14 is connected to a resistor 15. The other side of this resistor 15 is connected to a break-down element 16 having a bidirectional characteristic, e.g. a diac. The other side of this diac is connected to a control electrode of the semiconductor element 9. In addition, a node between the coil 8 and the resistor 13 is connected through a surge suppressor 17 to the control electrode of the semiconductor switching element 9. This control electrode is also connected to the electrode 5*b* of the lamp through a resistor 18. Finally the resistor 14 of the starter is shunted by a capacitor 19**.

The circuit described operates as follows. The case of a normally starting lamp 4 will first be considered. If the supply voltage is applied between the terminals 1 and 2 the capacitor 19 will first be charged through the series circuit 3, 6, 7, 8, 13. If then the breakdown voltage of the threshold element 16 is attained, a control signal will appear on the control electrode of the semiconductor switching element 9 which renders this switching element conductive. In the meantime, however, the capacitor 10 is also charged through the circuit 3, 6, 7, 10. If now the switching element 9 becomes conductive the capacitor 10 discharges and charges etc. in the oscillatory circuit 10, 8, 9. This results in a relatively high frequency oscillation. The pulses then produced appear between the lamp electrode **5*a* and 5*b* of the lamp 4. This lamp then ignites. In this situation so little current has flowed through the P.T.C. resistor 7 that it is hardly heated. If the lamp ignites, the voltage between its electrodes 5*a* and 5*b* decreases to a value of approximately 70 volts, i.e. the operating voltage of the lamp 4. This value is insufficient to charge capacitor 19 to the threshold voltage of the element 16. This means that the starter circuit formed by the components 6 to 19** inclusive is now substantially out of operation.

Now the case is considered wherein the lamp 4 is a lamp which refuses to ignite. In this case the situation will initially be the same as indicated above. However, because lamp 4 does not ignite, the P.T.C. resistor 7 will be heated still more so that it becomes increasingly high-ohmic and, consequently, will reduce the current strength in the series arrangement 6, 7, 8 etc. Thereafter the switching element 9 is occasionally made conductive. The pulses which as a consequence appear between the lamp electrodes **5*a* and 5*b* through the capacitor 11 now have a lower amplitude. Consequently they cause substantially no radio interference. If now, however, lamp 4 is replaced by a new, good lamp and assuming that the AC supply voltage between the terminals 1 and 2 remains available, the specified starting pulses between the lamp electrodes can be sufficient to ignite the new lamp. In the absence of the capacitor 11**, which has a capacitance value between 80 and 300 nF, this would not be the case.

An advantage of the circuit described is that also when replacing old lamps by new lamps the new lamps can ignite in spite of the hot state of the P.T.C. resistor 7.

Of course no problems are encountered when, prior to exchanging the lamp, the supply voltage is switched off, since the P.T.C. resistor 7 then gets a chance to cool down.

In a practical embodiment the self-inductance of the coil 3 is approximately one Henry and that of the coil 8 is also approximately one Henry. The capacitors 19, 10 and 11 each have a capacitance of approximately 100 nanofarad. The resistor 6 has a value of approximately 220 Ohm, the resistor 12 of approximately 27 kOhm, the resistor 13 of approximately 100 kOhm, the resistor 14 of approximately 18 kOhm, the resistor 15 of approximately 47 Ohm, and the resistor 18 of approximately 100 Ohm. The surge suppressor 17 has a forward voltage of approximately 350 Volts. The threshold voltage of the element 16 is approximately 32 Volts. In the cold state (room temperature of approximately 20° C.) the P.T.C. resistor 7 has an ohmic value of approximately 85 Ohm. If a lamp does not ignite within approximately 15 seconds, the temperature of the P.T.C. resistor is increased to approximately 130° C., at which temperature the ohmic value of the resistor is approximately 10 kOhm.

FIG. **2*a* shows diagrammatically the voltage V in Volts, between the lamp electrodes 5*a* and 5*b*, versus the time t in seconds, for the case where the P.T.C. resistor 7** is in the cold state. The AC supply voltage Vn is indicated by a dashed line.

FIG. **2*b* shows a similar graphic picture to that in FIG. 2*a*, however, for the hot state of the P.T.C. resistor 7**.

In the last-mentioned case—i.e. of a hot P.T.C. resistor—a relatively small voltage peak occurs only once in each half cycle.

What is claimed is:

1. A starter for igniting an electric discharge lamp comprising, two input terminals for connection to a first and a second electrode respectively of the lamp, a first capacitor, means interconnecting the input terminals by means of a series arrangement including an electric coil, a controlled semiconductor switching element and a parallel circuit comprising a PTC resistor and a second capacitor, and means connecting the first capacitor in shunt with a portion of the series arrangement comprising the coil and the semiconductor switching element.

2. A starter as claimed in claim 1, wherein the capacitance of the second capacitor is between 80 and 300 nanofarad.

3. An arrangement comprising a starter as claimed in claim 1 and further comprising a discharge lamp provided with two electrodes, means connecting one input terminal of the starter to one electrode and the second input terminal to the other electrode of the lamp, a pair of AC supply terminals, a stabilisation element having an inductive part, and means connecting the stabilisation element in series with the lamp across said pair of AC supply terminals.

4. An arrangement as claimed in claim 3, wherein the lamp comprises a low-pressure sodium vapour discharge lamp.

5. A starter circuit for an electric discharge lamp comprising, a first pair of terminals for connection to the lamp electrodes, a first capacitor, an inductor, a controlled semiconductor switching element, means connecting the first capacitor, the inductor and the semiconductor switching element together to form an oscillatory circuit having a frequency of oscillation greater than the frequency of the energy supply source for the discharge lamp, a second capacitor, a PTC resistor connected to form a parallel circuit with the second capacitor, means connecting the parallel circuit in series with the oscillatory circuit across said first pair of terminals so that the first capacitor is in shunt with the series arrangement of the inductor and the semiconductor switching element, and a control circuit coupled to a control electrode of the semiconductor switching element and to the first pair of terminals so as to provide a trigger voltage to the semiconductor switching element.

6. A starter circuit as claimed in claim 5 further comprising a second pair of terminals for connection to a source of AC supply voltage, and a ballast device coupling said first pair of terminals to said second pair of terminals.

7. A starter circuit as claimed in claim 5 wherein the parallel circuit, the inductor and the semiconductor switching element are connected in a series circuit across said first pair of terminals and the first capacitor is in shunt with that part of the series circuit that includes the inductor and the semiconductor switching element.

8. A starter circuit as claimed in claim 7 further comprising an impedance element connected in shunt with the inductor and a discharge lamp having first and second electrodes connected individually to the first pair of terminals.

9. A starter circuit as claimed in claim 5 wherein the capacitance of the second capacitor is chosen so that the second capacitor presents a low impedance to electric signals at said oscillation frequency and a high impedance at the frequency of the discharge lamp supply source.

10. A starter circuit as claimed in claim 9 further comprising a discharge lamp having first and second non-preheatable electrodes individually connected to the first pair of terminals, a second pair of terminals for connection to a source of AC supply voltage, and a ballast device coupling one terminal of said first pair of terminals to one terminal of said second pair of terminals.

* * * * *